United States Patent [19]

Morikane

[11] Patent Number: 5,016,484

[45] Date of Patent: May 21, 1991

[54] STARTER MOTOR

[75] Inventor: Hiroyuki Morikane, Himeji, Japan

[73] Assignee: Mitsubishi Denki Kabushiki Kaisha, Tokyo, Japan

[21] Appl. No.: 411,292

[22] Filed: Sep. 22, 1989

[30] Foreign Application Priority Data

Oct. 24, 1988 [JP] Japan ..... 63-138310[U]

[51] Int. Cl.[5] ..... F02N 11/00

[52] U.S. Cl. ..... 74/6; 74/7 A; 123/179 M; 290/48

[58] Field of Search ..... 74/6, 7 R, 7 A, 7 B, 74/7 C; 123/179 M; 290/38 R, 38 C, 48

[56] References Cited

U.S. PATENT DOCUMENTS

| | | | |
|---|---|---|---|
| 4,488,054 | 12/1984 | Ebihara | 74/6 |
| 4,590,811 | 5/1986 | Kasubuchi | 74/7 A |
| 4,737,654 | 4/1988 | Morishita et al. | 290/48 |

FOREIGN PATENT DOCUMENTS

| | | | |
|---|---|---|---|
| 59-32670 | 2/1984 | Japan | 74/7 R |
| 60-90983 | 5/1985 | Japan | 290/48 |
| 60-184965 | 9/1985 | Japan | 290/48 |
| 61-126371 | 6/1986 | Japan | 290/48 |
| 61-268869 | 11/1986 | Japan | 290/48 |
| 61-275571 | 12/1986 | Japan | 290/48 |
| 62-165475 | 10/1987 | Japan . | |
| 63-230960 | 9/1988 | Japan . | |

*Primary Examiner*—Leslie A. Braun
*Assistant Examiner*—Scott Anchell
*Attorney, Agent, or Firm*—Sughrue, Mion, Zinn, Macpeak & Seas

[57] ABSTRACT

A starter motor comprising; a solenoid switch having an attracting movable part; an electric motor arranged at one side in the axial direction; an output shaft driven by the electric motor; a one-way clutch unit carried on and around the output shaft so as to be slidable thereon; a shift lever having an upper end engaged with the attracting movable part, and a lower end engaged in a peripheral groove in the one-way clutch unit, the shift lever being arranged to be capable of rocking about a rocking fulcrum part which is positioned between the upper end and the lower end of the lever, and which is in touch with the inner surface of a front housing wall; wherein the lever has the upper end and the rocking fulcrum part positioned at the one side in the axial direction with respect to the lower end.

1 Claim, 2 Drawing Sheets

STARTER MOTOR

BACKGROUND OF THE INVENTION

1. Field of the Invention

The present invention relates to a starter motor and more particularly to a starter motor wherein a one-way clutch unit which is carried on and around an output shaft so as to be slidable is slided by a shift lever.

2. Discussion of Background

A conventional starter motor which has been used to start a vehicle engine is constructed as shown in FIG. 2.

The conventional starter motor 1 is constituted by a D C motor 2, a one-way clutch unit 4 carried on and around an output shaft 3 so as to be slidable, a planetary reduction gear unit 5 for reducing the torque of the armature shaft 2*a* of the motor 2 and transmitting the reduced torque to a clutch outer 4*a* of the one-way clutch unit 4, a solenoid switch unit 6 which is arranged at one side of the motor 2 to slide the one-way clutch unit 4 on the output shaft 3, and a shift lever 8 which has one end engaged with a hook 6*a* held by a plunger of the solenoid switch unit 6, and the other end engaged in a perpheral annular groove of an annular member 7 attached to the one-way clutch unit 4.

In the conventional starter motor 1, the rocking fulcrum 8*a* about which the shift lever 8 is rocked to slide the one-way clutch unit 4 on the output shaft 3, and an upper end 8*b* of the shift lever engaged with the hook 6*a* are positioned ahead of (in FIG. 2, at the right side of) the vertical line 9 passing through the lower end 8*c* of the shift lever. This creates a problem wherein the distance between an engine a mounting surface 10 of the starter motor and a pinion 11 in the retracted position, which is integral with the clutch inner 4*b*, is short, and the starter motor is, therefore, not applicable to a vehicle engine having a long distance between its engine mounting surface and its ring gear.

SUMMARY OF THE INVENTION

It is an object of the present invention to eliminate the disadvantage of the conventional starter motor and to provide a new and improved starter motor wherein the distance between the engine mounting surface and the pinion retraction position is long.

The foregoing and other objects of the present invention have been attained by providing a starter motor comprising; a solenoid switch having an attracting movable part; an electric motor arranged at one side in the axial direction; an output shaft driven by the electric motor; an one-way clutch unit carried on and around the output shaft so as to be slidable thereon; a shift lever having an upper end engaged with the attracting movable part, and lower end engaged in a peripheral groove in the one-way clutch unit, the shift lever being arranged to be capable of rocking about a rocking fulcrum part which is positioned between the upper and the lower end of the lever, and which is in touch with the inner surface of the front housing wall; wherein the lever has the upper end and the rocking fulcrum positioned at the one side in the axial direction with respect to the lower end. As a result, the rocking fulcrum part of the shift lever for sliding the one-way clutch unit, and the upper end engaged in the attracting movable part of the solenoid switch are positioned at a backward location in the axial direction with respect to the lower end engaged in the one-way clutch unit. This allows the solenoid switch and the inner surface of the front housing wall with which the rocking fulcrum part of the shift lever is in touch to be positioned at such backward location in the axial direction, providing the starter motor wherein the distance between the engine mounting surface and the pinion retracting position is long.

BRIEF DESCRIPTION OF THE DRAWINGS

A more complete appreciation of the invention and many of the attendent advantages thereof will be readily obtained as the same becomes better understood by reference to the following detailed description when considered in connection with the accompanying drawings, wherein.

DESCRIPTION OF THE PREFERRED EMBODIMENTS

Now, the present invention will be described in detail with reference to a preferred embodiment illustrated in the accompanying drawings.

Figure 1:
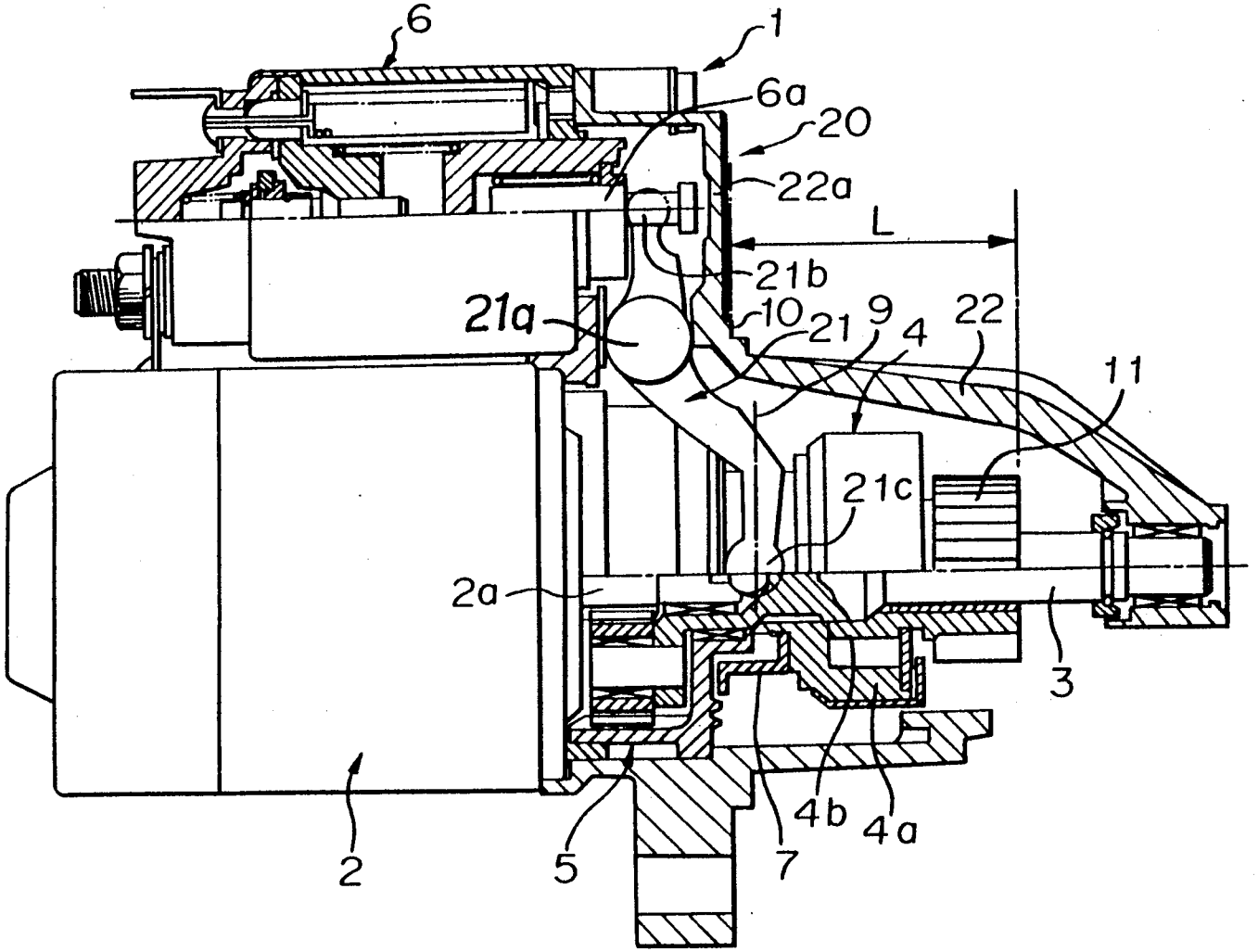
FIG. 1 is a front view of an embodiment of the starter motor to the present invention, wherein only the parts are shown in section.
Figure 2:
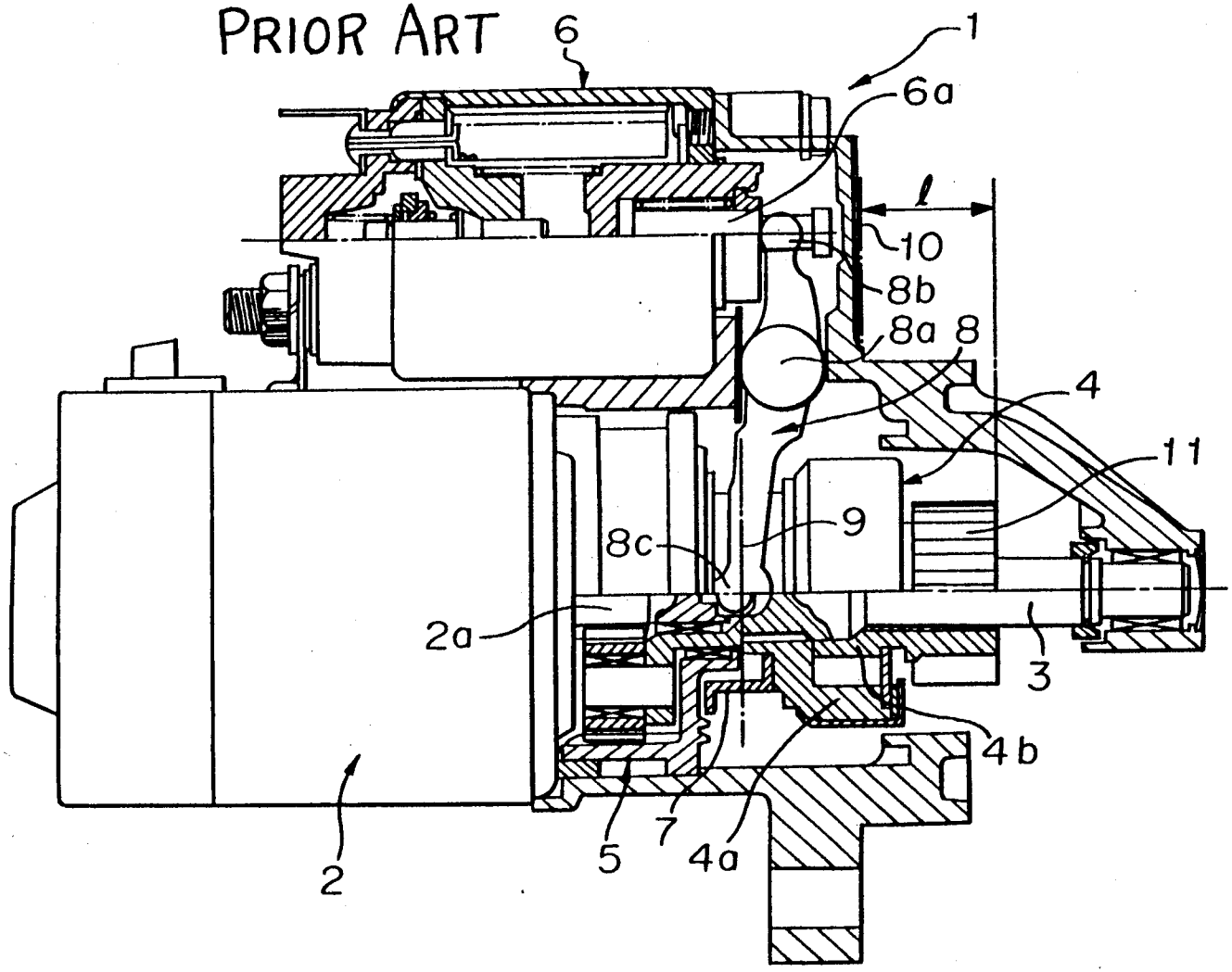
FIGURE 2 PRIOR ART
FIG. 2 is a front view of the conventional starter motor wherein only the essential parts are shown in section.

In FIG. 1, an embodiment of the starter motor 20 according to the present invention is shown. In FIG. 1, parts similar or corresponding to those of the conventional starter motor 1 shown in FIG. 2 are indicated by the same reference numerals. Explanation on such parts will be omitted for the sake of simplicity.

In the starter motor 20 of the embodiment, a shift lever 21 is dogleg shaped as clearly shown in FIG. 1. In the shift lever 21, a shift lever rocking fulcrum part 21*a*, and an upper end 21*b* which is engaged with a hook 6*a* held by a plunger of a solenoid switch 6 are positioned at a backward location with respect to the vertical line 9 which passes through a lower end 21*c* of the shift lever, and which forms a forked portion to be engaged in a peripheral annular groove in an annular member 7 of a one-way clutch unit 4.

The use of such shift lever 21 allows only the rocking fulcrum part 21*a* of the shift lever 21 and the upper end 21*b* to be located at a backward position in the axial direction without modifying the position of the one-way clutch unit 4. As a result, a solenoid switch covering part 22*a* of a front housing wall 22 which forms a surface with which the rocking fulcrum part 21*a* is in touch can be arranged at a backward position in comparison with the conventional starter motor, thereby allowing the distance L between an engine mounting surface 10 and the retracted position of a pinion 11 to be extremely lengthened.

Obviously, numerous modifications and variations of the present invention are possible in light of the above teachings. It is therefore to be understood that within the scope of the appended claims, the invention may be practiced otherwise than as specifically described herein.

What is claimed is:

1. A started motor comprising:

a solenoid switch (6) having an axially movable plunger (6*a*);

an electric motor (2) arranged below the switch and axially parallel thereto;

an armature shaft (2*a*) driven by the electric motor;

a reduction gear unit (5) coaxially surrounding the armature shaft and driven thereby, and including an output shaft (3) extending outwardly of the armature shaft and axially aligned therewith:

a one-way clutch unit (4), including a pinion gear (11), carried coaxially on the output shaft so as to be slidable thereon, said clutch unit being driven by the reduction gear unit, and the reduction gear unit being axially interposed between the motor and the clutch unit;

a shift lever (21) having an upper end (21*b*) engaged with the movable plunger, and a lower end (21*e*) engaged in a peripheral groove (7) in the one-way clutch unit, the shift lever being rockable about a fulcrum part (21*a*) which is positioned between the upper end and the lower end of the lever, and which is in engagement with an inner surface of a wall (22*a*) of a front housing enclosing the clutch unit;

wherein the lever is shaped as a dogleg, the upper end and the fulcrum part thereof are positioned axially inwardly, towards the motor and switch, with respect to the lower end, and the fulcrum part is positioned immediately above an outer circumference of the reduction gear unit to maximize an axial distance between an engine mounting surface (10) of the starter motor and a retracted position of the pinion gear.

* * * * *